United States Patent [19]

Kakinoki et al.

[11] Patent Number: 4,688,277

[45] Date of Patent: Aug. 25, 1987

[54] AUTOMATIC FAUCET APPARATUS

[75] Inventors: Toshiyuki Kakinoki; Kazuhiko Hirata, both of Kadoma, Japan

[73] Assignee: Matsushita Electric Works, Ltd., Osaka, Japan

[21] Appl. No.: 831,319

[22] Filed: Feb. 20, 1986

[30] Foreign Application Priority Data

Mar. 25, 1985 [JP] Japan ..... 60-60035

[51] Int. Cl.[4] ..... E03C 1/05

[52] U.S. Cl. ..... 4/623; 4/302; 4/305; 4/DIG. 3

[58] Field of Search ..... 4/623, 302, 305, DIG. 3; 251/129.01, 129.02, 129.08

[56] References Cited

U.S. PATENT DOCUMENTS

| | | | |
|---|---|---|---|
| 3,333,160 | 7/1967 | Gorski | 4/623 X |
| 3,406,941 | 10/1968 | Ichimori et al. | 251/129.01 |
| 3,487,477 | 1/1970 | Classen | 251/129.01 X |
| 3,556,146 | 1/1971 | Groen | 4/623 X |
| 4,402,095 | 9/1983 | Pepper | 4/623 |
| 4,520,516 | 6/1985 | Parsons | 4/623 |
| 4,598,726 | 7/1986 | Pepper | 4/623 X |
| 4,606,085 | 8/1986 | Davies | 4/623 |

FOREIGN PATENT DOCUMENTS

| | | | |
|---|---|---|---|
| 2853981 | 6/1980 | Netherlands | 4/623 |

*Primary Examiner*—Henry K. Artis

*Attorney, Agent, or Firm*—Burns, Doane, Swecker & Mathis

[57] ABSTRACT

An automatic faucet apparatus comprises a drive control means wherein an intermediate drive section coupled to a motor as normally resiliently biased toward the original position is interlocked to a driving shaft coupled to a valve member with a play involved in the interlocking, so that, when the motor is energized to provide an actuating torque to the intermediate drive section and is thereafter deenergized, the intermediate drive section can reset to the original position without requiring any motor output, while the driving shaft is prevented from being affected by the resetting of the intermediate drive section due to the play involved.

9 Claims, 22 Drawing Figures

AUTOMATIC FAUCET APPARATUS

TECHNICAL BACKGROUND OF THE INVENTION

This invention relates to automatic faucet apparatus for supplying hot and cold water automatically and, as required, manually.

The automatic faucet apparatus of the type referred to are installed on a kitchen or toilet sink, in a bath room or the like places requiring the hot and cold water supply for automatically and effectively performing such supply in response to the entrance of a user's body part into a sensing region.

DISCLOSURE OF PRIOR ART

There have been proposed such various automatic faucet apparatus as the ones, disclosed in, for example, U.S. Pat. No. 4,402,095 to Robert B. Pepper and U.S. Pat. No. 4,520,516 to Natan E. Parsons, in which ultrasonic transmitter and receiver are provided to a faucet to open and close an electromagnetically-actuated valve disposed in the faucet through a control means in response to the user's body part entering and leaving an ultrasonic sensing region. According to these automatic faucet apparatus, the automatic hot and cold water supply can be realized by means of a presence and absence in the sensing region of the user's hand.

In this type of the automatic faucet apparatus, though not suggested in both of the foregoing U.S. Patents, there have been demanded such improvements in their supply function that the faucet per se is horizontally rotatable, discharge amount as well as mixing ratio of hot and cold water are smoothly adjustable with a single manually operated lever, and so on. Less automatic faucet apparatus has realized these demands in generic manner, while required technique for each of them considered separately has been known to those skilled in the art. Further, it has been partly made known that a valve member is disposed in the faucet or in a water supply pipe communicating with the faucet for performing faucet opening and closing operation not electromagnetically but mechanically as actuated by normal and reverse rotational outputs of a reversible motor, and any electrically actuating means is electrically isolated from water supply path for safety purpose.

Accordingly, it may be possible that applications of the respective known arrangements of the rotary faucet, single manually operated lever, and mechanically motor-actuated valve member to the known automatic faucet apparatus of the foregoing U.S. Patents or the like will result in a faucet apparatus which is more or less satisfying the various demands.

However, certain problems are still unsolved in that, when the valve member is actuated only by the reversible motor, it is necessary that an actuator for the valve member is returned to its original position after the valve opening or closing to be ready for a next operation, which requires a normal or reverse rotation of the motor for every opening or closing operation, resulting in a complicated and expensive circuit arrangement, and that the apparatus cannot smoothly operate automatically when the user cannot use his hand as, for example, he holds something, because the sensing region is disposed at a level of the user's upper body half, in particular, for use with a hand.

TECHNICAL FIELD OF THE INVENTION

A primary object of the present invention is, therefore, to provide an automatic faucet apparatus which satisfies various demands with a simple and inexpensive arrangement providing a favorably easy usage.

According to the present invention, this object is realized by providing an automatic faucet apparatus which comprises a valve member provided in a hot and cold water supply path for being opened or closed, through a drive control means, by an output of a motor, an operating lever disposed in the vicinity of the water supply path and operatively coupled to the valve member for manual opening or closing thereof, and means for sensing the entrance of an object into a sensing region to generate a responsive output and operatively coupled to the drive control means, wherein the drive control means comprises an intermediate drive section coupled to the motor and a driving shaft coupled to the valve member, the intermediate drive section is interlocked to the driving shaft, while the intermediate drive section is resiliently biased to rest to the original position upon deenergization of the motor after an energization for actuating the intermediate drive section, and the interlocking between the intermediate drive section and the driving shaft involves a play allowing the intermediate drive section to reset as biased to the original position without causing the driving shaft to be displaced.

According to the present invention, in addition to the intended object thus attained, the automatic operation of the faucet apparatus can be realized by rotating the reversible motor only in one direction for the valve opening or closing operation, and the power consumption for the motor can be reduced to be contributive to energy saving.

Other objects and advantages of the present invention shall be made clear in the following description of the invention detailed with reference to preferred embodiments shown in accompanying drawings.

Figure 4:
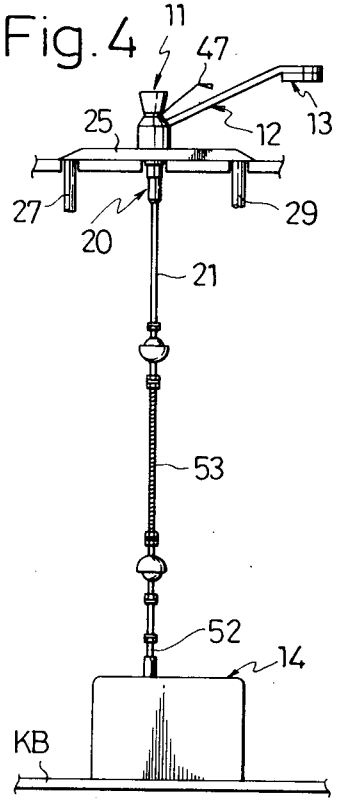
FIG. 4 is a partial side view for showing a state in which the hot and cold water supply means is interlocked to a drive control means in the apparatus of FIG. 1.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 1:
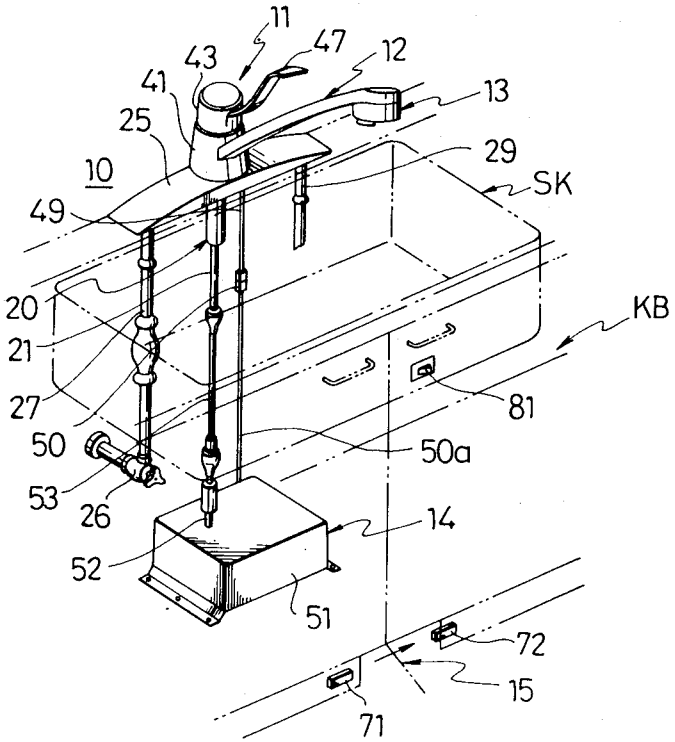
FIG. 1 is a perspective view in an embodiment of an automatic faucet apparatus according to the present invention, which is applied to a kitchen sink shown by imaginary lines.

Referring to FIG. 1, there is shown an embodiment of an automatic faucet apparatus 10 according to the present invention, as applied to a sink SK of kitchen equipment KB shown by imaginary lines. The apparatus 10 comprises a hot and cold water supply means 11 forming a part of a hot and cold water supply path, a faucet 12 directly coupled to the water supply means 11 to define a major part of the water supply path, a hand sensing means 13 disposed within an extended end of the faucet 12, a drive control means 14 operatively coupled to the water supply means 11, and a foot sensing means 15 mounted to the equipment to be on a floor and below the drive control means 14.

Figure 3:
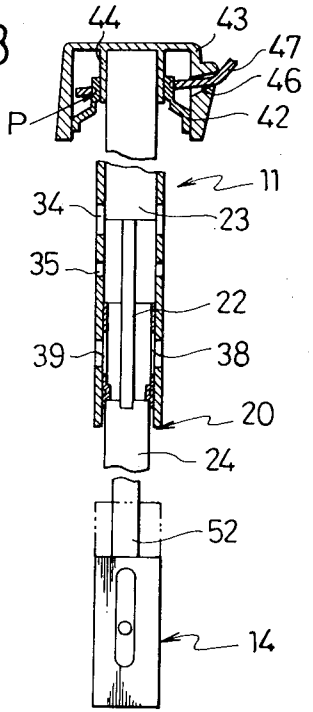
FIG. 3 is a fragmentary elevation, partly in section, mainly of the valve member and an inner supply cylinder in the hot and cold water supply means of FIG. 2.
Figures 2, 10:
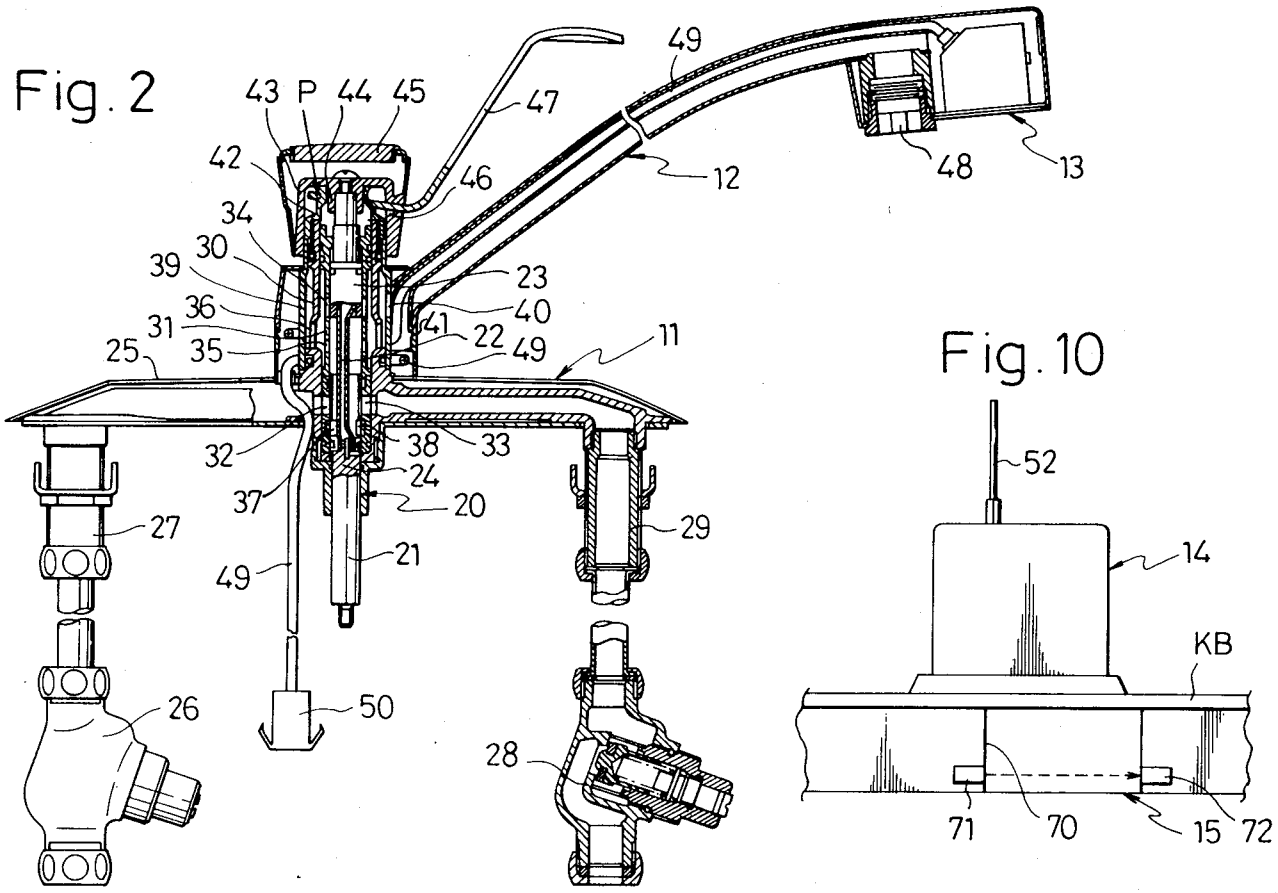
FIG. 2 is a vertically sectioned view as magnified and partly in a side elevation of a hot and cold water supply means including a faucet and valve member in the apparatus of FIG. 1.
FIG. 10 shows in a fragmentary side view a foot sensing means disposed below the drive control means in the apparatus of FIG. 1.
Figure 6:
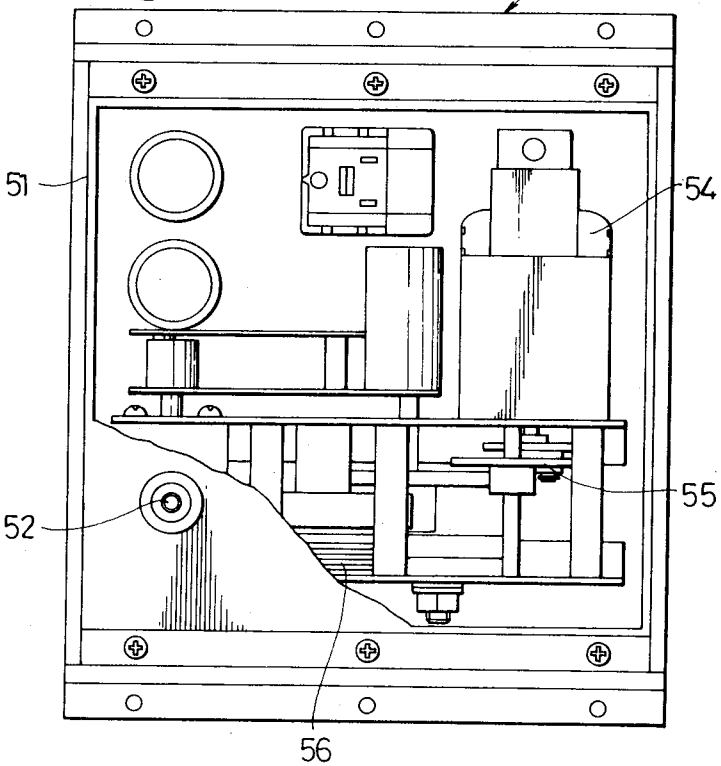
FIG. 6 is a top plan view of the drive control means in the apparatus of FIG. 1, with a casing partly cut away.
Figure 5:
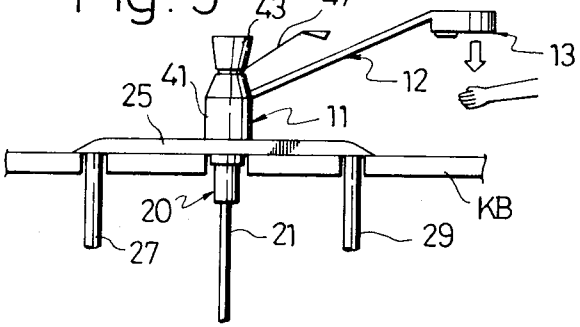
FIG. 5 is an explanatory view for the operation of a hand sensing means in the apparatus of FIG. 1.
Figure 11:
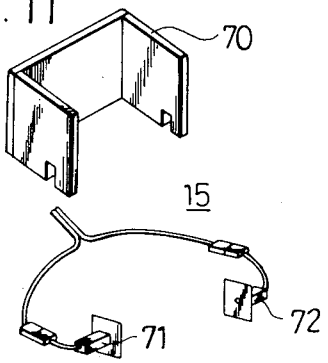
FIG. 11 is a perspective view as disassembled of the foot sensing means of FIG. 10.

Referring to FIGS. 2 and 3, the water supply means 11 includes in the central part a vertically movable valve member 20 which has a downwardly extended valve rod part 21, an upper valve part 23 and a hollow lower valve part 24 linked to each other by a tubular linkage part 22. The valve member 20 passes through the central part of a supply base 25 having an arcuate upper surface, and this supply base 25 is coupled at one end to a hot water supply pipe 27 including a check valve 26 and at the other end to a cold water supply pipe 29 including a check valve 28. The supply base 25 is provided in the central part with an erected intermediate pipe part 30 integrally formed or welded, into which an inner supply pipe 31 is fluid-tightly inserted with a sealing ring interposed. The valve member 20 is slidably inserted into the inner supply pipe 31 with a sealing ring interposed for prevention of leakage of water through slidably engaging surface of the valve member 20 with the inner periphery of the supply pipe 31.

In the illustrated embodiment, the intermediate pipe part 30 and inner supply pipe 31 are provided with a hot water inlet 32 and a cold water inlet 33 made through both pipes 30 and 31, the hot water inlet 32 is opened to a side of the supply base 25 coupled to the hot water supply pipe 27, while the cold water inlet 33 is opened to a side of the supply base 25 coupled to the cold water supply pipe 29. The inner supply pipe 31 is formed to have a plurality of upper and lower outlets 34 and 35 in its upper part extending through the erected part 30 of the supply base 25, respectively as mutually circumferentially spaced. The upper part of the erected intermediate pipe part 30 of the supply base 25 is spaced from the peripheral surface of the inner supply pipe 31, and has outlets 36 respectively circumferentially spaced from each other at a level slightly above the lower outlets 35 of the supply pipe 31. The hollow lower valve part 24 of the valve member 20 is provided with hot and cold water inlets 37 and 38 which can communicate with the hot and cold water inlets 32 and 33 respectively when the valve member 20 is at open position. While the hot and cold water inlets 37 and 38 are made to communicate simultaneously with the hot and cold water inlets 32 and 33, the former inlets are circumferentially extended in asymmetrical relation to each other with respect to the axis of the lower valve part 24 so that, when the valve body 20 is rotated about its axis, only one of the inlets 37 and 38 will communicate with a corresponding one of the inlets 32 and 33 to pass either hot water or cold water.

A support cylinder 39 is mounted on the supply base 25 to fit around the erected intermediate pipe part 30 as radially slightly spaced therefrom. More particularly, the support cylinder 39 engages rotatably but liquid-tightly through a sealing ring about the base portion of the intermediate pipe part 30, and is provided with a hot and cold water outlet 40, and the faucet 12 is coupled to the cylinder 39 to communicate therewith through the outlet 40. Provided on the supply base 25 is a cover cylinder 41 which surrounds the support cylinder 39 as well as the base part of the faucet 12 as radially spaced from the cylinder 39.

The inner supply pipe 31, intermediate pipe part 30 and support cylinder 39 are liquid-tight joined mutually at their upper ends through sealing rings. Fixedly mounted onto the top end of the intermediate pipe 30 is a lever holder 42 the outer peripheral surface of which is substantially flush with the outer periphery of the upper end of the support cylinder 39, and a valve coupler 43 is mounted on the lever holder 42 to fit also over the support cylinder 39 but to be axially vertically and rotatively movable with respect to the holder 42 and cylinder 39. The valve coupler 43 is provided on its inner upper surface with a coupling projection 44 extruded into a central opening of the lever holder 42, and is secured to the upper end of the valve member 20 by a screw or the like means. The valve coupler 43 is covered by a cap 45 and is formed to have in the peripheral wall a through hole 46, through which an end portion of an operating lever 47 bent substantially into an L shape is inserted into the valve coupler 43. In the present instance, the through hole 46 of the movable valve coupler 43 is shaped to allow the operating lever 47 to vertically rock, while the operating lever 47 is provided in the end portion with an opening with which the lever 47 is fitted about the upper part of the fixed lever holder 42 as engaged at tip-end side edge of the opening into an annular groove formed in the upper part of the holder 42. When the operating lever 47 is caused to vertically rock with the tip-end side edge engaged to the fixed lever holder 42 as a fulcrum P (FIG. 3), therefore, the movable valve coupler 43 is made to vertically shift together with the valve member 20 as well as its upper and lower valve parts 23 and 24 within the inner supply pipe 31. Similarly, a rotation of the operating lever 47 about the fixed lever holder 42 and along the annular groove causes the movable valve coupler 43 and valve member 20 to be rotated about their axis.

The faucet 12 is of a hollow tubular shape rectangular in section and slightly curved, and is extended above the sink SK. As the support cylinder 39 to which the faucet 12 is coupled in rotatable about the intermediate pipe 30 of the supply base 25, a manual application of a rotary force to the faucet 12 enables the faucet to be rotated to any desired angular position with respect to the sink. The hand sensing means 13 is provided adjacent a downward water outlet 48 of the faucet 12 formed at extended tip end, and comprises preferably an ultransonic sensor or alternatively a photoelectric sensor having a wiring cord 49 guided along a guide path defined in the faucet 12, through the support cylinder 39 and the supply base 24, to the lower side of the base 24. In guiding through the support cylinder 39, it is preferable that the cord 49 is wound about the cylinder several times, so that any tension likely to occur in the cord 49 during the rotation of the faucet 12 can be prevented. Further, the cord 49 is provided at a downward extended end led out of the supply base 25 with a connector 50 for another wiring cord 50*a* from the drive control means 14.

Referring next to FIGS. 4 to 12, the drive control means 14 generally comprises a waterproof casing 51 and a driving shaft 52 projected vertically upward out of the casing 51 to be axially shiftable as liquid-tightly sealed with respect to the casing, and the drive shaft 52 is coupled through a coupling rod 53 having universal joints at both ends to the valve member 20 of the water supply means 11, so that the valve member 20 will be automatically driven through the control means 14 to axially shift up and down. More in detail, a reversible motor 54 is housed in the casing 51, an output shaft of which motor is operatively connected through a reduction gear train 55 to an intermediate drive section 56 which comprises an intermediate driving plate 57 substantially of a knife shape and a pair of resetting plates 58 and 59 each of which is substantially L-shaped, and these plates 57 to 59 are pivotably supported substantially at their central part by a common shaft 60 held horizontally in the casing 51. A cooperating roller 61 is provided on one side of the tip end of the intermediate driving plate 57, and is loosely fitted in an elongate hole 63 of a coupler 62 fixed to the lower end of the driving shaft 52 within the casing. A pair of stop pins 64 and 65 are projected in the casing 51 as mutually spaced in the vicinity of a rear end 57*a* of the intermediate driving plate 57 so that the driving plate 47 can rotate limitedly within a range defined between the stop pins 64 and 65 for shifting the valve body 20 up and down through the coupling roller 61.

Further, the intermediate driving plate 57 is provided, on the other side of the tip end having the roller 61, with a push pin 66 projected in opposite to the roller 61, while the two L-shaped resetting plates 58 and 59 are disposed in symmetrical relation with respect to the common pivot shaft 60 with their one leg portions of the L-shaped directed oppositely upward and downward and respectively engaged to an end of each of tension springs 67 and 68 to be biased for mutual approach and normally into abutment with the push pin 66 from below and above at the other leg portions of the resetting plates 58 and 59. A reference pin 69 projected in the casing 51 is positioned between the mutually approaching leg portions of the resetting plates 58 and 59 to stop their further rotation due to the biasing of the tension springs 67 and 68.

Figure 8:
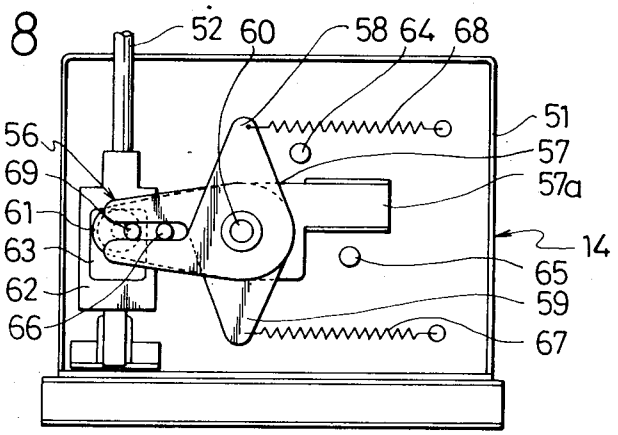
FIGS. 8 and 9 are schematic side views of the control means of FIG. 6 shown in its different operating states.
Figure 9:
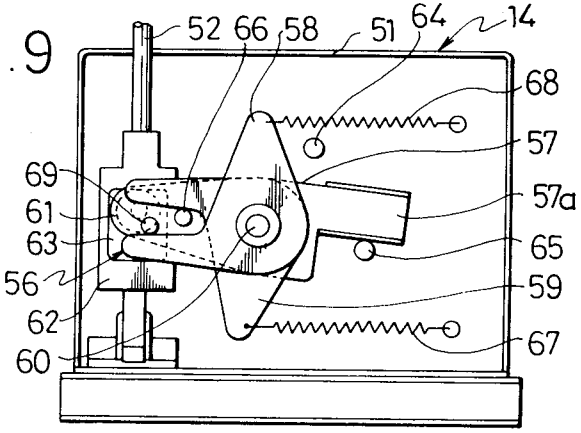
Figure 7:
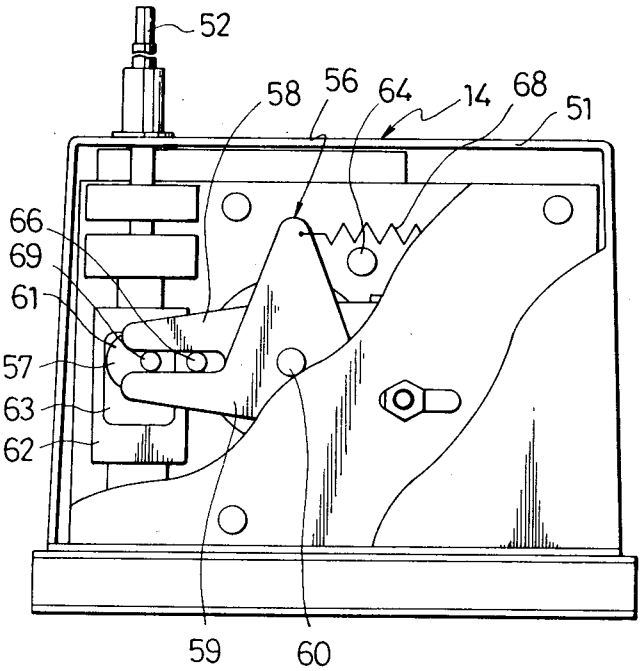
FIG. 7 is a side view of the control means of FIG. 6, with the casing partly cut away.

When, for example, a normal directional rotation of the motor 54 causes clockwise rotation of the driving plate 57 of the intermediate driving section 56, the coupler 62 as well as the valve member 29 is moved, through the coupling roller 61 of the driving plate 57, upward into a position of FIG. 9 from a position of FIG. 7 or 8 so that the push pin 66 of the drive plate 57 pushes up the above-positioned leg portion of the resetting plate 59 against the biasing force of the tension spring 67 to similarly rotate the resetting plate 59 clockwise. The reversible motor 54 is arranged to be deenergized upon completion of this operation for the upward shift of the valve member 20, upon which the resetting biasing force of the spring 67 so far increased with the clockwise rotation of the resetting plate 59 is made active to urge the pin 66 of the intermediate driving plate 57 downward to rotate the plate 57 anticlockwise, i.e., to reset to the original position. Because the roller 61 of the intermediate driving plate 57 is loosely fitted in the elongated hole 63 of the coupler 61 to the driving shaft 52, the roller 61 shifts downward in the hole 63 together with the resetting motion of the driving plate 57, while the valve member 20 and driving shaft 52 remains frictionally in their upward shifted position. Thus, the motor 54 is made not contributive to the resetting motion of the intermediate driving plate 57 to the original position, so as to save the required energy. It will be appreciated that such resetting of the intermediate driving plate 57 is necessary for assuring a constant amount of the shift of the driving plate 57 that achieves reliably a predetermined distance of the upward or downward motion of the valve member 20. Now, in order to shift the valve member 20 downward, the motor 54 is rotated in the reverse direction, whereby the intermediate driving plate 57 is rotated counterclockwise to shift the roller 61 downward in the hole 63 of the coupler 61, urging the coupler 61 as well as the driving shaft 52 and valve member 20 to shift downward. During this counterclockwise rotation of the driving plate 57, the below-positioned leg portion of the other resetting plate 58 is urged by the pin 66 of the plate 57 to rotate also counterclockwise to increase the resetting biasing force of the other spring 68 so that, upon completion of the downward shift of the valve member 20 with the motor 54 also deenergized, the driving plate 57 can be reset to the original position by the biasing force of the spring 68. The elongated hole 63 of the coupler 61 is made to have a clearance between the roller 61 and the upper and lower edges of the hole 63, so that the roller 60 will abut the upper or lower edge of the hole 63 only during the upward or downward shifting of the valve member 20 as driven by the driving plate 57.

Figure 13:
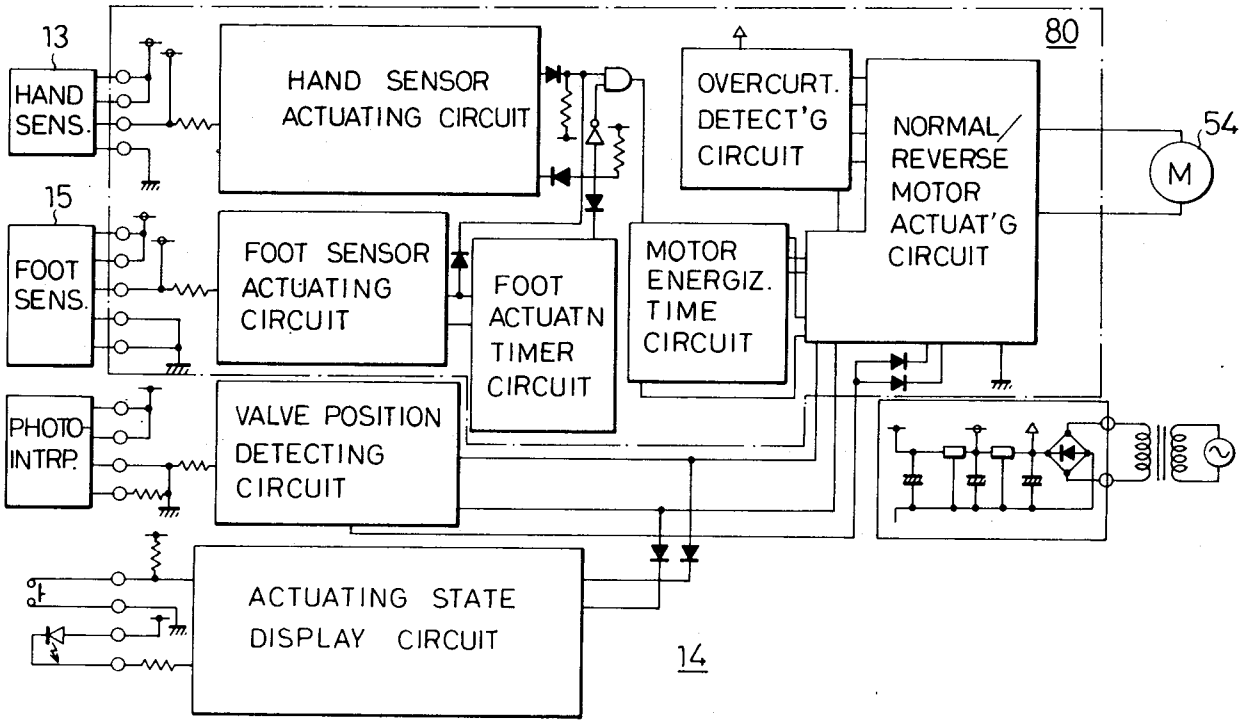
FIG. 13 is a circuit diagram for showing partly in block diagram electric connection of electric components in the apparatus of FIG. 1.

The foot sensing means 15 disposed below the drive control means 14 is a light beam sensor installed in a sensor frame 70 and comprises beam transmitter and receiver 71 and 72 disposed on opposing side walls of the frame 70 to allow the user's toe to be inserted between them. In the illustrated embodiment, the foot sensing means 15 is electrically connected to a control circuit 80 in parallel to the hand sensing means 13, so that the hand and foot sensing means 13 and 15 can detect the presence and absence of the user's hand and foot and provide a water supply or stop signal to the control circuit 80, while this control circuit 80 per se is arranged to be turned ON or OFF by means of a power supply switch 81 and, as turned ON, to provide an actuating signal to the reversible motor 54 for its normal or reverse rotation in response to the water supply or stop signal from the hand and foot sensing means 13 and 15. For the drive control circuit 80, such a circut as shown in FIG. 13 may preferably be used. Further, in practical applications, the automatic faucet apparatus 10 is preferably provided with means for displaying the position of the valve member or actuating state of the faucet, utilizing a photointerrupter or the like, as also shown in FIG. 13.

The operation of the automatic faucet apparatus according to the present invention shall now be referred to briefly.

In the manual operation mode, an upward rocking of the operation lever 47 causes the upward motion of the valve member 20 from the water stop position of FIG. 2 to the water supply position of FIG. 3, whereby the hot and cold water inlets 37 and 38 of the lower valve part 24 of the valve member 20 are brought into alignment with the hot and cold water inlets 32 and 33 of the intermediate and inner supply pipes 30 and 31, respectively, and hot water and cold water are simultaneously supplied through the supply base 25 from the both hot and cold water supply pipes 27 and 29. The hot water and cold water thus introduced into the lower valve part 24 are passed through the interior of the inner supply pipe 31, guided from the inner supply pipe 31 through the upper and lower outlets 34 and 35 thereof into the intermediate pipe 30, and then reach the interior of the support cylinder 39 through the inlet 36 of the intermediate pipe 30. Until they reach the support cylinder 39, the hot water and cold water are fully mixed to a warm water and, as guided from the support cylinder 39 through the outlet 40 thereof into the faucet 12, the warm water is eventually discharged from the outlet 48.

In manually rocking the operating lever 47, a properly selected degree of the lever's upward shift achieves one of a variaty of inflow rate of the hot and cold water and thus of the amount of warm water discharged out of the faucet 12 since such selective upward shift of the lever causes a change of the aligned area of the inlets 32, 33 of the intermediate and inner supply pipes 30, 31 with the inlets 37, 38 of the lower valve part 24. When the operating lever 47 is rotated in either one of horizontal directions, the aligned area between the hot water inlets 32 and 37 or between the cold water inlets 33 and 38 is made to vary and thus the mixture ratio between the hot water and cold water can be changed.

In the automatic operation mode, the presence of the user's hand in a sensing region of the hand sensing means 13 is thereby sensed, the water supply signal is sent from the means 13 to the control circuit 80 of the drive control means 14 so that the control circuit causes the reversible motor 52 to rotate in the normal direction. This causes the driving plate 57 of the intermediate driving section 56 to be rotated clockwise in FIG. 7, and the valve member 20 is driven upwardly. As a result, the valve member 20 shifts from the water stop position to the water supply position, resulting in that water is discharged from the outlet 48 of the faucet 12 through the same supply path as referred to in the manual operation mode. Upon completion of the driving of the intermediate plate 57, the motor 54 is deenergized, but the driving plate 57 is reset to the reference position, i.e., the original position, due to the biasing force of the tension spring 67, whereupon the roller 61 of the intermediate driving plate 57 is disengaged from the edge portion of the elongate hole 63 in the coupler 62 of the valve member 20, so that the resetting motion of the driving plate 57 will give no affection on the position of the valve member 20. As the intermediate driving plate 57 resets, the roller 61 of the plate is placed to be free from the edge portion of the elongate hole 63 to get ready for the next operation. When the user's hand is drawn out of the sensing region of the hand sensing means 13, the water stop signal is sent to the control circuit 80 so that the control circuit 80 causes the motor 54 to rotate in the reverse direction, whereby the driving plate 57 of the intermediate driving section 56 is driven counterclockwise in FIG. 7, and the valve member 20 is moved to the water stop position of FIG. 2.

In the case where the user's hand is engaged, the user places a toe in the sensor frame 70 of the foot sensing means 15 and the water supply or stop signal is provided to the control circuit 80 of the drive control means 14 as in the case of the hand sensing means 13, whereby the same operation as that explained above in connection with the hand sensing means 13 is performed.

Figure 14:
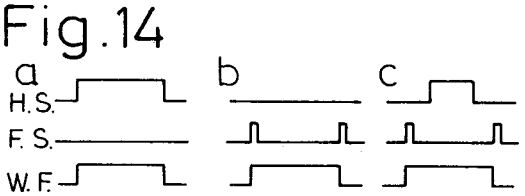
FIGS. 14*a, b* and *c* are timing charts in different operating states of the hand and foot sensing means and water supply.
Figure 15:
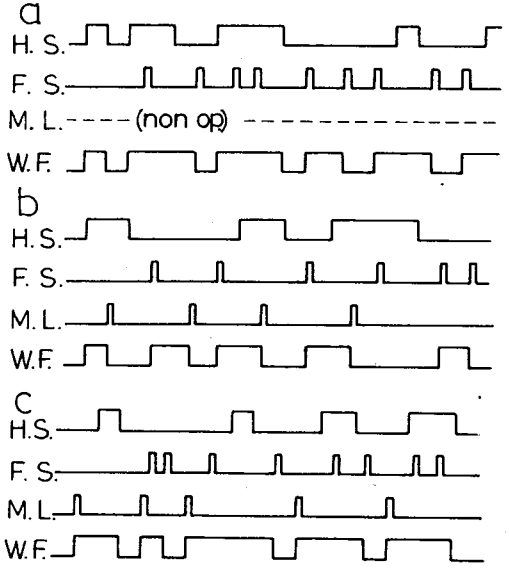
FIGS. 15*a, b* and *c* are timing charts in different operating states of the hand and foot sensing means, manual lever operation and water supply.
Figure 12:
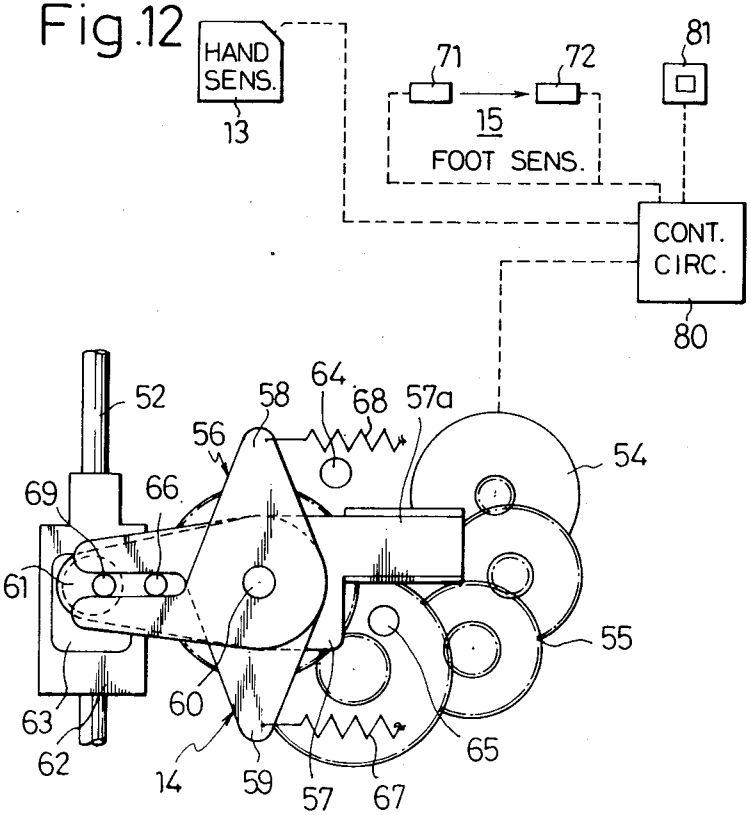
FIG. 12 is an explanatory view for electric connection of the hand and foot sensing means to motor-driven mechanical arrangement in the apparatus of FIG. 1.

Referring to FIGS. 14 and 15, there are shown various operational modes, in binary form, of the automatic faucet apparatus. FIG. 14 shows different water supply states W.F. corresponding to different combination modes of the hand sensing means H.S. with the foot sensing means F.S., whereas FIG. 15 shows different water supply states W.F. corresponding to different combination modes of the hand sensing means H. S., foot sensing means F.S. and manual lever operation M. L., wherein the ON and OFF states of the respective means are represented by high and low levels, respectively. More specifically, the apparatus can be arranged in such that the user's hand actuates the hand sensing means 13 to realize the water supply even in the absence of the sensed output of the foot sensing means 15 as shown in FIG. 14*a*, that the water supply is started and continued as the user's toe enters once the foot sensing means 15 until the toe again enters even in the absence of the sensed output of the hand sensing means 13 as shown in FIG. 14*b*, and that the output of the foot sensing means 15 is made to have priority over the output of the hand sensing means 13 for the continuous water supply as shown in FIG. 14*c*. It will be understood that FIG. 15*a* shows practical water supply states with a combination of the respective modes of FIG. 14*a*, *b* and *c*. Further, it is preferable that, as shown in FIGS. 15*b* and 15*c*, the manual operation of the operating lever 47 has priority over the operation of the valve member 20 in response to the outputs of the hand and foot sensing means 13 and 15. Of course, the operational modes of the respective means are illustrated only as several examples in FIGS. 14 and 15 and other various operational modes may be selectively set. When the power supply switch 81 connected to the control circuit 80 of the drive control means 14 is turned OFF, the hand and foot sensing means 13 and 15 are of course no more activatable, and only the manual control by means of the operating lever 47 is available. In accordance with the automatic faucet apparatus of the present invention, consequently, not only the water supply by means of the manual operation and of the hand sensing means but also the water supply in the combined modes of the supply by means of the foot sensing means with the above supply can be realized, so that a variety of water supply modes can be realized with a remarkably improved usage.

Figure 18:
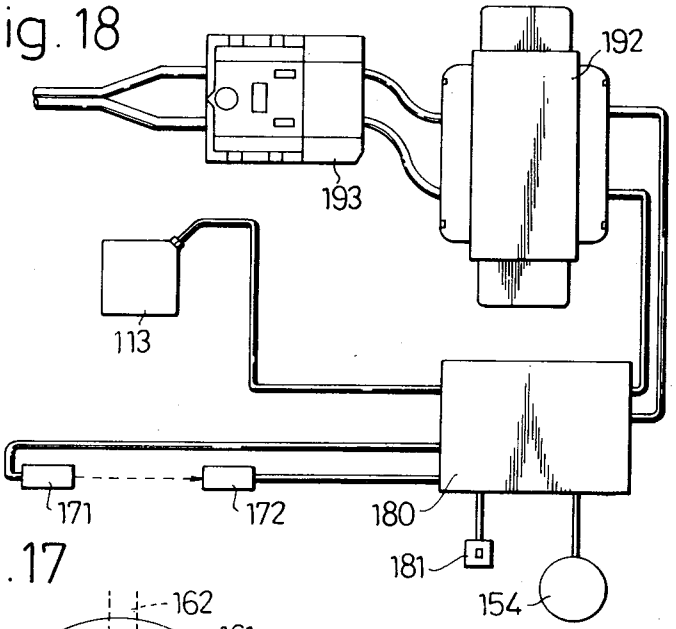
FIG. 18 is a schematic view for showing an electric connection in the automatic faucet apparatus using the drive control means of FIG. 16.
Figure 17:
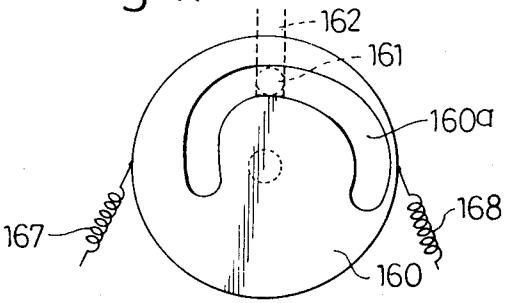
FIG. 17 is a side view of a cam plate cooperating with an intermediate drive section in the drive control means of FIG. 16.
Figure 16:
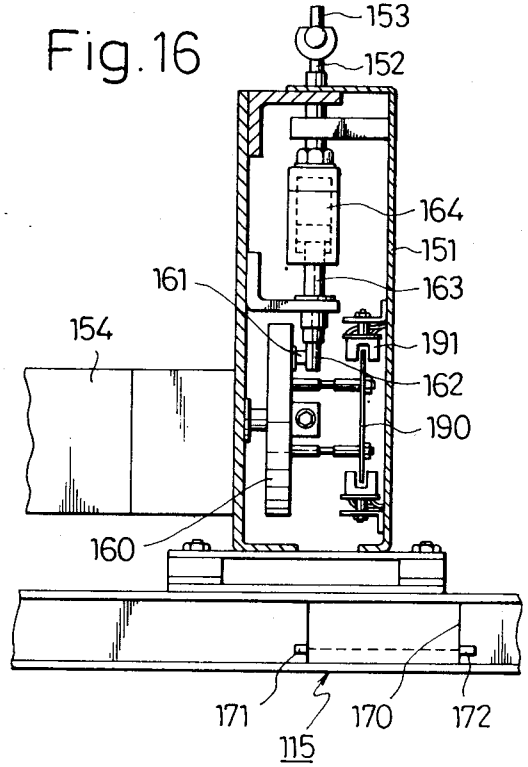
FIG. 16 is a vertically sectioned view in another embodiment of the drive control means according to the present invention.

Referring finally to FIGS. 16 to 18, the automatic faucet apparatus is shown with another embodiment of the drive control means employed. In the present instance, the drive control means comprises a cam plate 160 directly coupled to an output shaft of a reversible motor 154 and provided with a cam groove 160*a* in which a slide rod 161 is slidably engaged. This rod 161 is connected through a coupling rod 162 and a piston rod 163 to a piston 164 coupled to a driving shaft 152 linked through a coupling rod 153 to the valve member (not shown), and these members from the cam plate 160 to the piston 164 are forming the intermediate driving section. Secured to the cam plate 160 as parallelly spaced therefrom is a rotary disc 190 for motor control, along the circumference of which rotary disc 190 a control switch 191 is disposed to detect a predetermined angular rotation of the rotary disc 190 to thereby deenergize the motor 154.

The cam groove 160*a* of the cam disc 160 is formed, in the illustrated embodiment, to be asymmetrical so as to be gradually closer to the rotary center of the disc 160 while running from an outermost positioned end of the groove to the other innermost positioned end, as shown in FIG. 17 so that, when the motor 154 is driven to rotate the cam disc 160 to have the sliding rod 161 moved to the outermost end of the cam groove 160*a*, the piston rod 163 as well as the driving shaft 152 will shift upward, whereas a rotation of the cam disc 160 for moving the sliding rod 161 to the other innermost end of the cam groove 160*a* will cause the piston rod 163 and driving shaft 152 moved downward. With such rotation of the cam disc 160 for moving the sliding rod 161 toward either one of the both ends of the cam groove 160*a*, the motor control rotary disc 190 rotating in unison with the cam disc 160 causes the motor control switch 191 to be turned OFF, to stop the current supply to the motor 154 for deenergizing it, responsive to which a resilient force of one of tension springs 167 and 168 symmetrically engaged at their one end to the cam disc 160 which has been so far expanded by the disc rotation is activated to bias the disc in a resetting rotary direction, as soon in FIG. 17, so as to be ready for the next operation. Since, in this embodiment, the cam disc 160 is interlocked with the driving shaft 152 through the piston 164 which providing an allowance of movement, substantially the same "clearance" as the loose fitting of the roller 61 in the elongated hole 63 in the foregoing embodiment can be provided, and the same function as the drive control means in the foregoing embodiment can be realized. It is preferable in practice that, as shown in FIG. 18, a power supply to a control circuit 180 for the drive control means is made through an insulating transformer 192 and a terminal block 193. In FIGS. 16 to 18, the same members as those in the foregoing embodiment are denoted by the same reference numerals but added by 100 except for those explained above.

It should be appreciated that, while the ultransonic and photoelectric sensors have been referred to as being utilizable as the hand sensing means, any electric sensors of other types may be similarly employed.

We claim as our invention:

1. An automatic faucet apparatus comprising a valve member disposed within a hot and cold water supply path for opening and closing motion with respect to said supply path, an operating lever provided in the vicinity of said supply path and interlocked to said valve member for manual operation thereof for said opening and closing motion, a motor providing an actuating output to said valve member, a drive control means including an intermediate drive section coupled to said motor to be thereby actuated and a driving shaft coupled to said valve member and interlocked to said intermediate drive section, said intermediate drive section being resiliently biased to reset to the original position upon deenergization of said motor after an energization for actuating the intermediate drive section, and said interlocking between said intermediate drive section and said driving shaft involving a play which allows the intermediate drive section to reset due to said biasing without causing the driving shaft to be displaced, and means having a sensing region for sensing an entrance of an object into said region and generating a responsive output which is provided to said drive control means to activate a desired water flow.

2. An apparatus according to claim 1, wherein at least two of said sensing means are provided.

3. An apparatus according to claim 1, wherein said sensing means comprises a hand sensing means and a foot sensing means.

4. An apparatus according to claim 3, wherein said hand sensing means is disposed in the vicinity of an outlet of said water supply path, and said foot sensing means is mounted to a lower part of an object with respect to which said apparatus is installed.

5. An apparatus according to claim 4, wherein said water supply path includes a faucet having said outlet, said hand sensing means comprises an electric sensor provided next to said outlet of said faucet, and said foot sensing means comprises a light beam sensor including a sensor frame and a pair of light transmitter and receiver mounted to said sensor frame as opposed to each other.

6. An apparatus according to claim 1, wherein said intermediate drive section comprises a rotary member to be rotated by said motor output, and said driving shaft includes means coupled to the driving shaft for interlocking it to said rotary member as spaced therefrom by a predetermined clearance.

7. An apparatus according to claim 6, wherein said rotary member is a substantially knife-shaped intermediate driving plate pivotably supported on a shaft and an interlocking roller provided to a free end of said intermediate driving plate, and said interlocking means of said driving shaft is a member having an elongate hole larger than said interlocking roller for loosely fitting therein the interlocking roller.

8. An apparatus according to claim 7, wherein said drive control means is housed in a casing carrying therein said support shaft for said intermediate driving plate, said intermediate drive section further comprises a pair of substantially L-shaped resetting plates pivotably supported commonly on said support shaft along with said intermediate driving plate to be mutually symmetrical with respect to the support shaft so as to dispose their one legs of said L-shape on said free end side of the driving plate with other legs directed mutually in opposite directions with respect to the support shaft, said resetting plates respectively receiving at said other legs a resilient biasing force for causing said one legs to approach each other, said casing further carries therein a reference pin disposed between said approaching one legs of said resetting plates to define their original position, and said intermediate driving plate carries a push pin disposed also between said approaching one legs of said resetting plates for separating the legs from the original position when the intermediate driving plate is rotated.

9. An automatic faucet apparatus comprising a faucet having an outlet, a hot and cold water supply path connected to said faucet, a valve member disposed in said supply path for opening and closing the path, a manual operating lever interlocked to said valve member in the vicinity of said faucet for manual operation of said opening and closing of the supply path, a reversible motor for providing normal and reverse directional outputs for actuating said valve member, a drive control means actuated in response to either one of said normal and reverse directional outputs of said reversible motor, an electric hand sensing means disposed adjacent said outlet of said faucet and providing a sensed-hand output to said drive control means, and a light-beam foot sensing means including a pair of opposed light transmitter and receiver and installed at a lower part of an object with respect to which said apparatus is installed, said foot sensing means providing a sensed-foot signal to said drive control means, wherein said drive control means comprises an intermediate driving plate receiving at one end said outputs of said motor and supported to be rotatable at the other free end in normal and reverse directions within a predetermined range as driven by either one of said outputs of said reversible motor, a pair of resetting plates supported to be pivotable along said free end of said intermediate driving plate and mutually in opposite direction with respect to an intermediate reference position of said normal and reverse rotations of the intermediate driving plate in response to the rotation thereof against a resilient resetting biasing force given to each of said resetting plates for resetting it to said reference position upon termination of each of said rotations of the intermediate driving plate, a roller carried at said free end of said intermediate driving plate, and a driving shaft interlocked at one end to said valve member and having a hole for receiving therein said roller of said intermediate driving plate, said hole being so dimensioned in axial direction of said driving shaft as to provide to said roller as well as said intermediate driving plate a play that allows the intermediate driving plate to reset to said reference position upon termination of said motor output in response to said resetting of said resetting plates.

* * * * *